United States Patent [19]

Wu

[11] Patent Number: 4,906,825

[45] Date of Patent: Mar. 6, 1990

[54] GOLF CART RANGE FINDER

[76] Inventor: Jiin-Tang Wu, No. 35-1, Jih Hsin Rd., Tu Chen Hsiang, Taipei Hsien, Taiwan

[21] Appl. No.: 282,237

[22] Filed: Dec. 9, 1988

[51] Int. Cl.[4] ..... G01C 22/00

[52] U.S. Cl. ..... 235/95 R; 235/96

[58] Field of Search ..... 235/95 R, 95 B, 96, 235/97, 119

[56] References Cited

U.S. PATENT DOCUMENTS

| | | | |
|---|---|---|---|
| 2,742,229 | 4/1956 | Hacking | 235/95 R |
| 3,357,636 | 12/1967 | Ferro, Sr. | 235/95 R |
| 3,629,557 | 12/1971 | Lareau | 235/95 R |
| 4,517,450 | 5/1985 | Coue | 235/95 R |

*Primary Examiner*—B. R. Fuller

*Attorney, Agent, or Firm*—Varndell Legal Group

[57] ABSTRACT

This invention relates to a golf cart range finder and, more particularly, to a range finder which makes use of precision gear ratio resulting from the rotation of the golf cart wheels, where the amount of wheel rotation is converted into a numerical reading for user reference. The invention permits the golf player to know the distance of each shot and includes a wheel axle track encoder having a miter gear wheel and a guide rod mounted on a wheel axle so that displacement of wheel axle is synchronously transmitted by a transmission cord to a counter placed on the end of the body of the cart. The precision gear set of said counter converts the wheel rotation into an accurate shot distance reading for the player's reference.

3 Claims, 3 Drawing Sheets

GOLF CART RANGE FINDER'

BACKGROUND AND SUMMARY OF THE INVENTION

In the modern, prosperous and flourishing society, people do not only demand for plentiful material supply but also require to frequently enjoy quality recreational activities. In consequence, related consumer goods come with the tie of fashion. Following fast development the in technology industry, recreational and sports goods are relatively improved in function as well as in design and thus provide better performance for practice and for making corrections in practice. At the present time, golf has become a sport popularly accepted by the people everywhere in the world. However, to a beginner, it is difficult to play. One should have to deep a correct striking posture to strike the ball with proper force applied in correct direction so as to hit the ball a correct distance. On an outer golf links, the ground is uneven, and the distance is difficult to correctly measured by eyes. Any error in range measurement may lead to a poor result due to deviation of point of application, or may even result an error in striking technique and thus interfere with improvement. Further, a golf cart is normally used to carry golf clubs, golf bags and other accessories, which provides no additional advantages for application. The gear sets of golf cart are vertically engaged and the transmission cords hung outside of the cart and get tangled with miscellaneous articles or interfere with movement within the transmission cords.

The main object of the present invention is to provide a golf cart range finder where a wheel axle track encoder is concentrically mounted on the wheel axle, and a gear set is mounted on the main shaft of the cart for transmission of the rotational displacement of the wheels of the cart to a counter for providing an accurate distance reading for user reference.

Other objects, features, and advantages of the present invention will be more apparent from the following descriptions and the attached drawings as hereunder.

DETAILED DESCRIPTION OF THE PREFERRED EMBODIMENT

Figure 1:
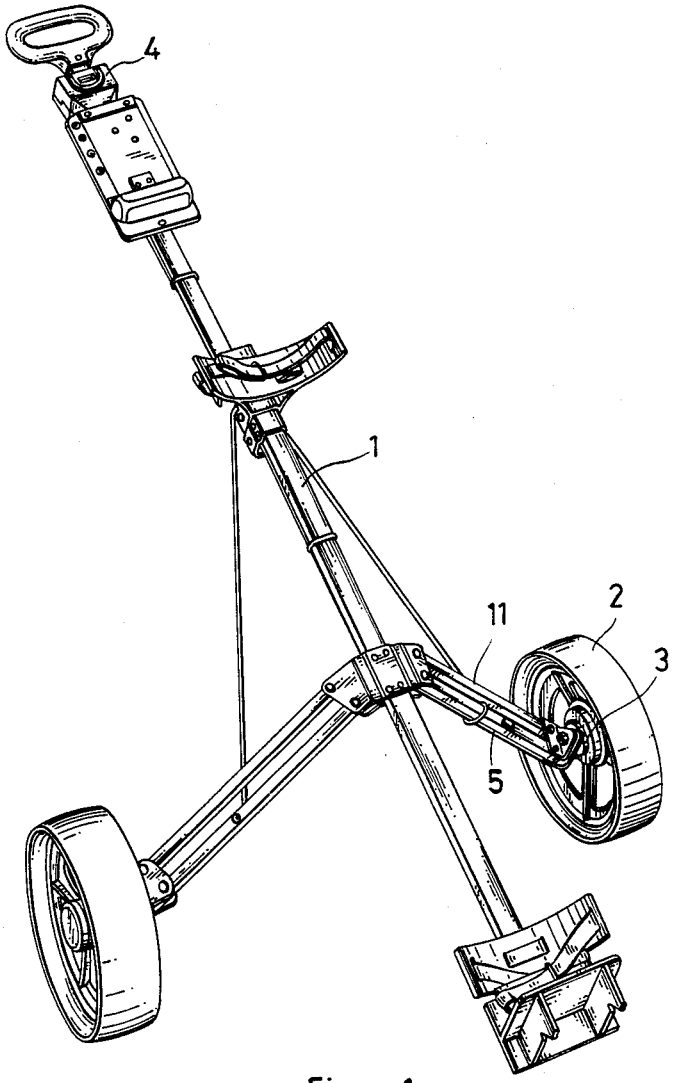
FIG. 1 illustrates the arrangement of the present invention on a golf cart.

Referring to the arrangement of the present invention as shown in FIG. 1, the body 1 of a golf cart has an equilateral triangular frame for landing, with one pair of wheels 2 pivotally attached to the equidistant slant frames 11 at both sides. An axle track encoder 3 is mounted on a wheel axle of one of said wheels 2. A counter 4 is mounted on the body 1 at the top adjacent to the draw bar holder. A tramsmission cord 5 is arranged to connect said axle track encoder 3 and said counter 4 such that the rotational displacement of the wheels 2 drives said axle track encoder 3 to make a circular action which is counted by said counter 4 via transmission cord 5. Therefore, a precise gear ratio is used for converting rotational displacement of the wheels 2 into an accurate distance reading for reference.

Figure 2:
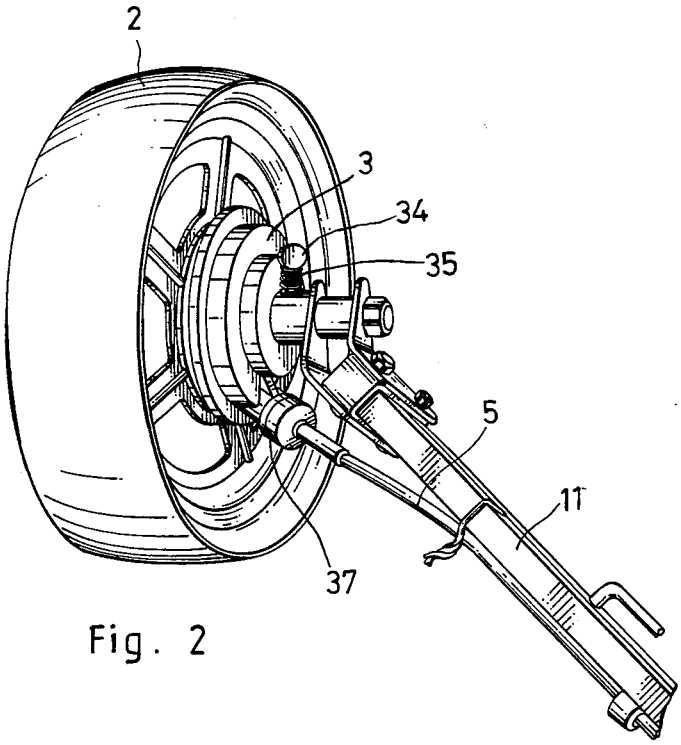
FIG. 2 is a perspective view of an axle track encoder of the present invention.
Figure 3:
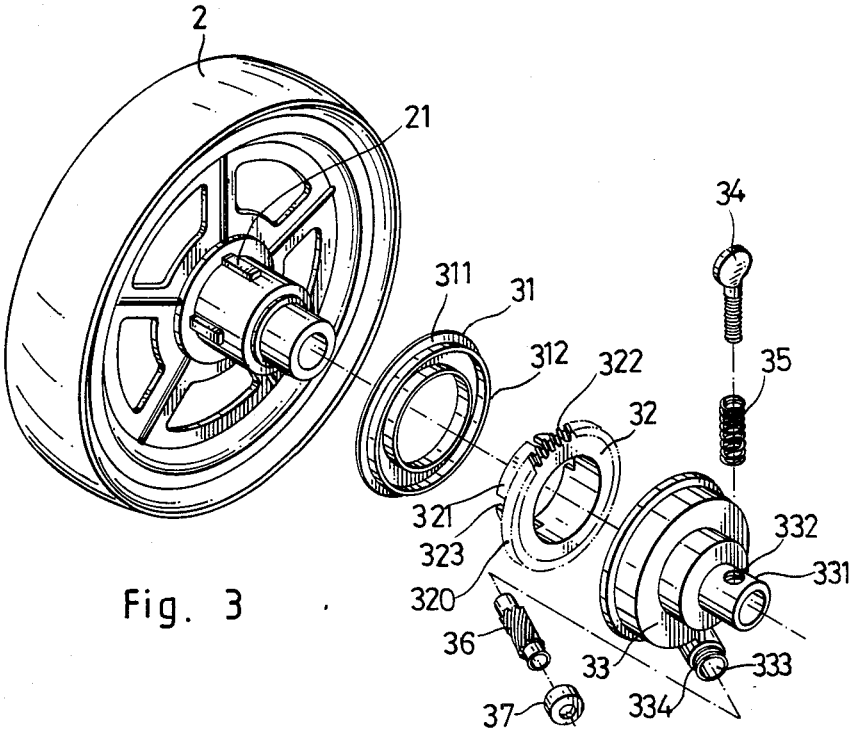
FIG. 3 is a perspective fragmentary view of the axle track encoder of FIG. 2.
Figure 4:
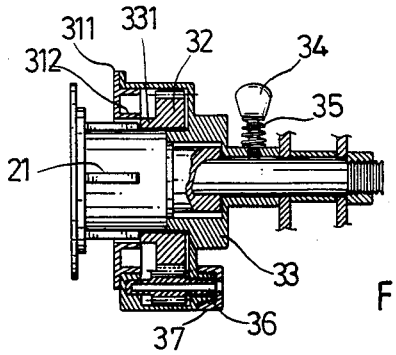
FIG. 4 is a side and sectional view of the axle track encoder of FIG. 2.

Please refer to the perspective, fragmentary and sectional view drawings of the said axle track encoder as shown in FIGS. 2, 3 and 4. The encoder 3 is comprised of a wheel 2, a sleeve cap 31, a miter gear wheel 32, a wheel hub cap 33, a locking pin 34, a spring 35 and a guide rod 36 (as shown in FIG. 3). Said wheel 2 comprises a plurality of blocking struts 21 equidistantly placed about the axle to block up and drive said axle track encoder 3. Said sleeve cap 31 which is mounted on the wheel axle is a hollow ring-shaped disc including a hollow circular surface 311 confining thereinside two circular walls 312 of different inner diameter concentrically and vertically disposed. Said miter gear wheel 32 which is set in said sleeve cap 31 includes a stepped circular surface 320, 321, wherein the wider circular surface 320 comprises a plurality of equidstantly arranged miter teeth 322, and the smaller circular surface 321 comprises a plurality of retaining grooves 323 correspondingly made to match with the blocking struts 21 for locking. Said wheel hub cap 33 covers said miter gear wheel 32 and comprises a circular wall surface made on its inner side surrounding the hollow caliber of said miter gear wheel 32 (as illustrated in FIG. 4), so as to confine the rotation of said miter gear wheel 32. The wheel hub cap 33 also has a stepped tube 331 on its other side. The stepped tube 331 has a round hole 332 on its front end of smaller diameter for said spring 35 and said locking pin 34 to be set therein, so that the whole assembly of axle track encoder 3 can be firmly fixed on the wheel axle. An eccentric manifold 333 is attached to the stepped tube 331 at the wider caliber portion for connection of said transmission cord 5 (as illustrated in FIG. 2). Eccentric manifold 333 comprises a thread 334 made at its front. Said guide rod 36 which is set in said manifold 333 comprises inclined thread 361 to match with said miter gear wheel 32. Transmission cord 5 is connected to guide rod 36 and a cap 37 is screwed onto said manifold 333.

Figure 5:
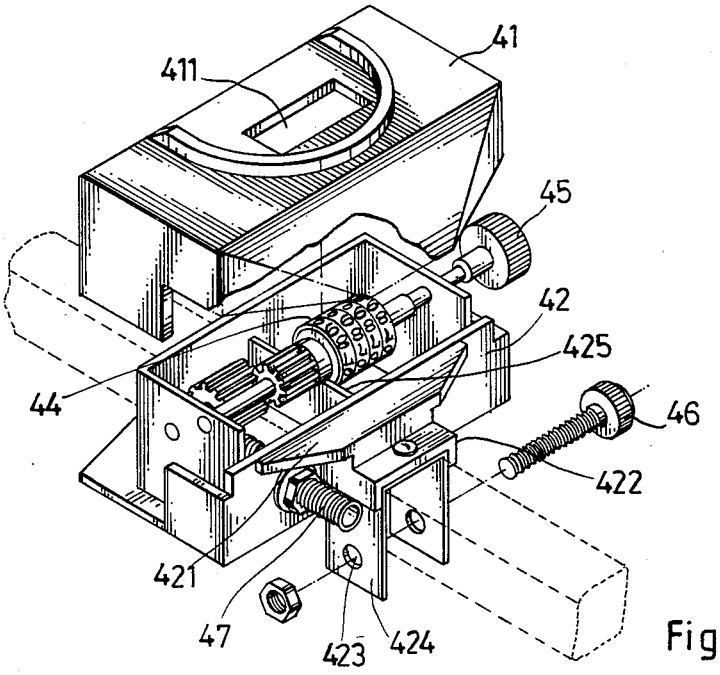
FIG. 5 is a perspective fragmentary view of a counter of the present invention.
Figure 6:
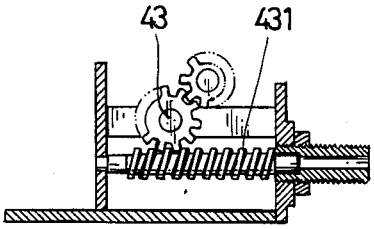
FIG. 6 is a side and sectional view of the counter of FIG. 5.

Referring to the perspective fragmentary and sectional view drawings of the counter as shown in FIGS. 5 and 6, the counter is comprised of a housing 41, a casing 42, a gear set 43, a numerical counting element 44, and a zero rest button 45. Said casing 42 includes a front block 421 having an inverted U-shaped notch 422 through the bottom end of said casing. An inverted U-shaped frame 424 is pivotally connected to said inverted U-shaped notch 422 at the and has a hole 423 bilaterally made on both side walls. Said casing 42 is mounted on the main shaft of the body 1 and is fastened thereto by means of a screw rod 46 through said the holes 423 of said inverted U-shaped frame 424. A lower partition wall 425 within the casing 42 divides it into two spaces. A driving portion 47 protrudes beyond one of said spaces of said casing 42 and is horizontally disposed in parallel with said front block 421. One end of said driving portion 47 is connected to the guide rod 36 of said axle track encoder 3 by means of said transmission cord 5, and the other end of said driving portion 47 is connected with a screw rod 431 to further engage with said gear set 43. Said gear set 43 is comprised of two gear wheels vertically disposed to engage with each other as shown in FIG. 6, wherein the upper gear wheel is concentrically mounted on the axle of said numerical counting element 44 on the partition wall. The axle of said numerical counting element 44 is extended to protrude beyond said casing 42 at one end for setting thereon of said zero reset button 45. A housing 41 is arranged to provide a configuration suitable for covering said casing 42, having a window 411 made on the top above said numerical counting element 44 for visual checking therethrough and for reading said numerical element 44 presented.

I claim:

1. A golf cart range finder comprising a body with a draw bar holder arranged between two wheels having a counter mounted on an upper portion thereof adjacent to said draw bar holder, an axle track encoder concentrically mounted on a wheel axle of one of said two wheels, and a transmission cord connecting said axle track encoder and said counter for transmitting rotational movement of said wheels to said counter;

said axle track encoder having a sleeve cap, a miter gear wheel, a wheel hub cap covering said sleeve cap and said miter gear, and an inclined and eccentric manifold mounted on said wheel hub cap, said manifold containing a guide connected to said transmission cord and engaging said miter wheel.

2. A golf cart range finder according to claim 1, wherein said sleeve cap including two concentric and protruding cylinders of different diameter;

said miter gear wheel has a stepped circular surface defining larger and smaller circular surfaces, said larger circular surface having a plurality of equidistantly arranged miter teeth, and said smaller circular surface having a plurality of retaining grooves for receiving blocking struts protruding from said wheel axle; and said wheel hub cap has a cylindrical wall facing said wheel, a stepped tube having two steps and extending from said cylindrical wall, and an inclined and eccentric manifold, said cylindrical wall confining rotation of said miter gear wheel, said stepped tube having a round hole on its front end for receiving a spring and a locking pin and firmly fixing said axle track encoder on said wheel axle, and said manifold being attached to a larger of said two steps of said stepped tube.

3. A golf cart range finder comprising a body with a draw bar holder arranged between two wheels having a counter mounted on an upper portion thereof adjacent to said draw bar holder, an axle track encoder mounted on a wheel axle of one of said two wheels, and a transmission cord connecting said axle track encoder and said counter for transmitting rotational movement of said wheels to said counter;

said counter having a casing with a front block having an inverted U-shaped notch and an inverted U-shaped frame pivotally connected to said inverted U-shaped notch, said inverted U-shaped frame having a hole on both side walls thereof, said casing being mounted on a main shaft of said body by a screw rod passing through said holes and said main shaft, said casing having a lower partition wall dividing said casing into two spaces respectively containing a gear set and a numerical counting element, a driving portion protruding beyond one of said two spaces and being horizontally disposed in parallel with said front block, one end of said driving portion being connected to said guide axle track encoder by said transmission cord and another end of said driving portion engaging said gear set, said gear set having upper and lower gear wheels vertically disposed to engage with each other, said upper gear wheel being concentrically mounted on an axle of said numerical counting element, said axle of said numerical counting element having an end extending beyond said casing with a zero reset button thereon; and a housing enclosing said casing and having a window for reading said numerical counting element.

* * * * *